US008876178B1

(12) United States Patent
Minter et al.

(10) Patent No.: US 8,876,178 B1
(45) Date of Patent: Nov. 4, 2014

(54) SLIDING DOOR HANDLE WITH PIVOT PINS

(71) Applicant: Interlock USA, Inc., Reno, NV (US)

(72) Inventors: Peter J. Minter, Reno, NV (US); Samuel T. Johnson, Reno, NV (US)

(73) Assignee: Interlock, USA, Inc., Reno, NV (US)

( * ) Notice: Subject to any disclaimer, the term of this patent is extended or adjusted under 35 U.S.C. 154(b) by 0 days.

(21) Appl. No.: 13/651,740

(22) Filed: Oct. 15, 2012

Related U.S. Application Data

(60) Provisional application No. 61/547,351, filed on Oct. 14, 2011.

(51) Int. Cl.
*E05B 3/00* (2006.01)
*E05B 65/08* (2006.01)

(52) U.S. Cl.
USPC ..... 292/336.3; 70/95

(58) Field of Classification Search
USPC ..... 16/412; 292/336.3, 33, 138, 177; 70/95
See application file for complete search history.

(56) References Cited

U.S. PATENT DOCUMENTS 856,214 A * 6/1907 Berger ..... 292/173
4,973,091 A * 11/1990 Paulson et al. ..... 292/51
5,092,144 A * 3/1992 Fleming et al. ..... 70/95
6,264,252 B1 * 7/2001 Clancy ..... 292/196
7,712,801 B2 * 5/2010 Xu et al. ..... 292/216
8,083,269 B2 * 12/2011 Mitchell ..... 292/52
8,083,296 B2 * 12/2011 Dandurand et al. ..... 305/166
8,491,022 B2 * 7/2013 Liebel et al. ..... 292/336.3
2008/0129054 A1 * 6/2008 Tremble et al. ..... 292/33
2009/0160202 A1 * 6/2009 Kosunen ..... 292/358
2009/0225183 A1 * 9/2009 Tamura ..... 348/222.1
2010/0327612 A1 * 12/2010 Liebel et al. ..... 292/336.3

* cited by examiner

*Primary Examiner* — Kristina Fulton
*Assistant Examiner* — Thomas Neubauer
(74) *Attorney, Agent, or Firm* — DeLio, Peterson & Curcio, LLC

(57) ABSTRACT

A door handle for a sliding door having a handle and a handle base having a pair of opposed arms. The arms are provided with corresponding clips, each clip having an opening that receives a corresponding pivot pin. The handle pivots between the arms on the pivot pins. The pins are axially aligned and slidably installed in the clips for sliding motion to extend towards and retract away from each other, into and out of engagement with the handle. With the pins extended, they engage the handle, preferably with each pin engaging a corresponding insert in each end of the handle. With the pins retracted, the handle may be removed from between the arms of the handle base. The pins are preferably held in the extended position with corresponding wedges that snap into the corresponding clips behind the pins.

19 Claims, 4 Drawing Sheets

SLIDING DOOR HANDLE WITH PIVOT PINS

BACKGROUND OF THE INVENTION

1. Field of the Invention

The present invention relates to door handles for use with sliding doors, such as sliding glass patio doors and the like. More particularly, the invention relates to a pivot system for pivoting a handle on a handle base attached to the door.

2. Description of Related Art

Sliding doors such as sliding glass patio doors and the like are well-known in the art. Doors of this type are commonly used in apartment units for access to a deck and in homes for access to the outside, such as to a patio, etc. Sliding glass patio doors typically include one or more central glass panes mounted within a surrounding vinyl, metal or wood frame. The frame slides between open and closed positions on a lower track and is guided by an upper track.

When closed, a vertical stile on the door abuts a vertical jamb on the door frame. The door jamb includes a strike and the vertical stile is provided with a handle that operates a mortised lock assembly. The lock assembly normally includes one or more hook-shaped latches that engage the strike on the adjacent door jamb to lock the door and prevent unauthorized movement to an open position.

To open the door, it is necessary to disengage the hook shaped latches from the strike and then slide the door along the track to the open position. Many conventional sliding doors have a fixed handle and a separate knob or latch handle. The knob or latch handle operates the mortised lock assembly to disengage the hook-shaped latches from the strike. The fixed handle is then used to slide the door along the track, away from the adjacent door jamb.

However, more modern sliding door handle designs have a movable handle instead of a fixed handle. The moving handle is pivotally attached to a base. Pivoting the handle operates the mortised lock mechanism to retract the latches. The handle, which is already grasped by the user, can then be used to slide the door.

The present invention is directed to a pivoted handle of the type described above. More specifically, it is directed to the pivoting mechanism for the handle that connects the pivoting handle to the handle base with a pair of pivot pins, one on each end of the handle.

Existing designs are not quiet and do not operate smoothly. Often the pivoting mechanism is part of the handle or the base. Such pivots often squeak and may wear rapidly. They do not provide a quality impression. Further, they may wear rapidly, and once worn, the handle or the base needs to be completely replaced.

It would be desirable to have a smoothly operating handle that operates quietly and does not wear rapidly. It would further be desirable to have a handle that can be more easily assembled and disassembled, particularly in the field, with pivot components that can be easily replaced without requiring replacement of the handle or base.

SUMMARY OF THE INVENTION

The present invention includes a pair of pivot pins, axially aligned, but located at opposite ends of the handle. Arms project upward from the base and the handle is pivoted between the arms on the pivot pins. The pins slide axially towards and away from the handle.

When the pivot pins slide towards the handle, they engage the handle, in plastic inserts located in ends of the handle. This traps the handle on the pins so that it cannot be removed, but is free to rotate. When the pins slide away from the handle, they disengage from the handle and allow it to be removed or inserted.

The pins are held in plastic clips located within the arms of the base. Because the pins are metal, while the clips in the base and the inserts in the handle are plastic, the pivoting operation is smooth, low friction and extremely quiet.

When the pins are in the engaged position, one end of each extends into its respective insert in the handle and the other end extends into its respective clip in the corresponding arm of the base. To hold the pins in the engaged position, each clip is provided with a respective plastic wedge. The wedge drives its corresponding pivot pin away from the clip and into engagement with the insert in the handle. As the clip reaches the fully seated position, it snaps into position in the clip.

The handle base attaches to a mounting plate on the door. The mounting plate includes a drive spindle that rotates to drive the mortised lock assembly and disengage the hook latches. The handle drives the spindle, preferably with a partial bevel gear on the handle and a beveled pinion gear on the spindle. Only a partial bevel gear is required due to the limited angular pivoting motion of the handle.

The base preferably surrounds the outside of the mounting plate so that it cannot be seen when the handle is mounted on the door. The mounting plate preferably acts to ensure that the wedges are fully seated and can't retract when the handle base is attached to the mounting plate.

The wedges are preferably provided with an opening allowing a screw driver to be inserted to retract them from the snapped in engagement with their respective clip to allow easy disassembly. Grooves in the pins allow them to be moved axially.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to the drawings above in which like numerals refer to like features of the invention.

Figure 1:
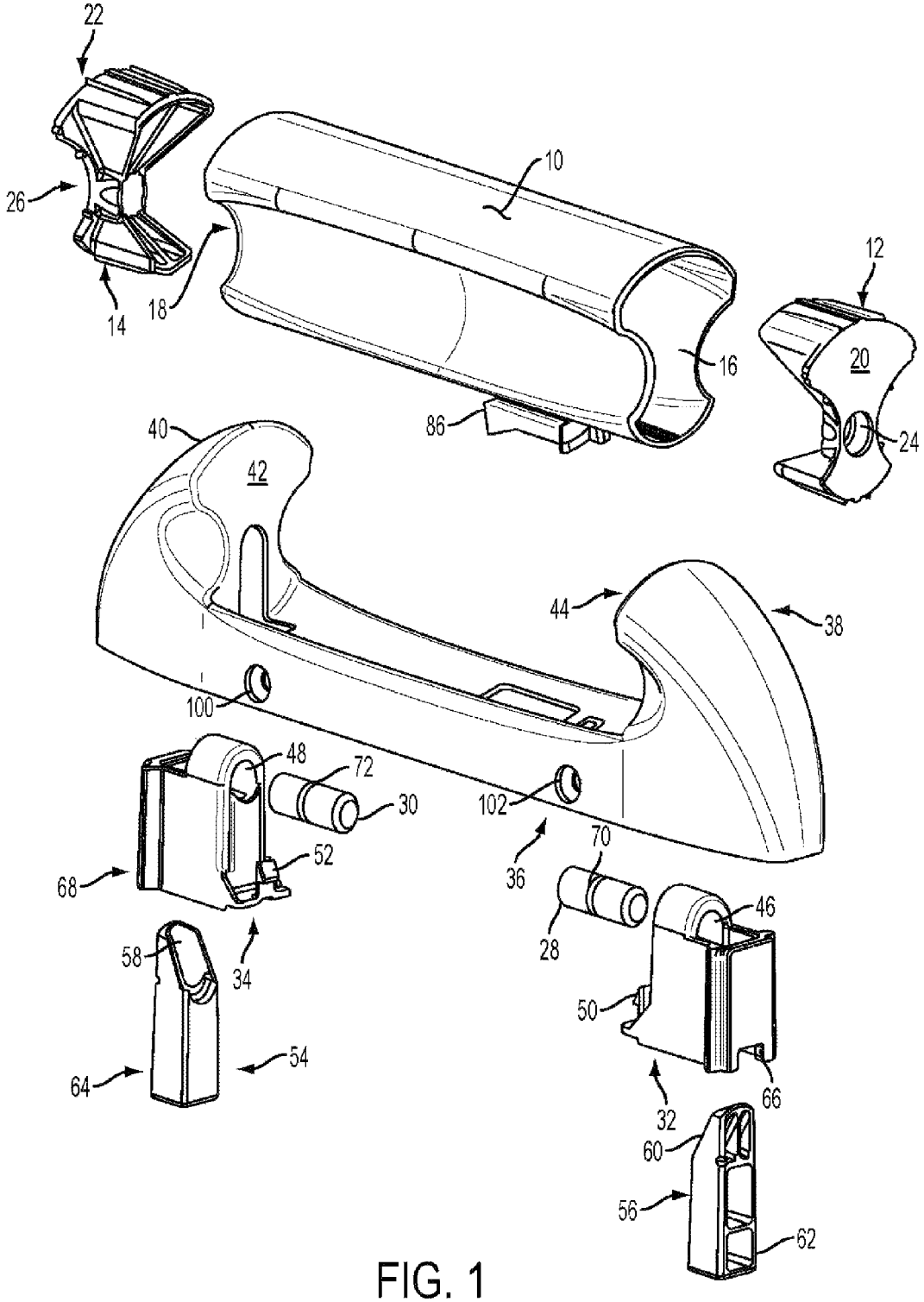
FIG. 1 is an exploded perspective view of a handle mechanism according to the present invention.
Figure 2:
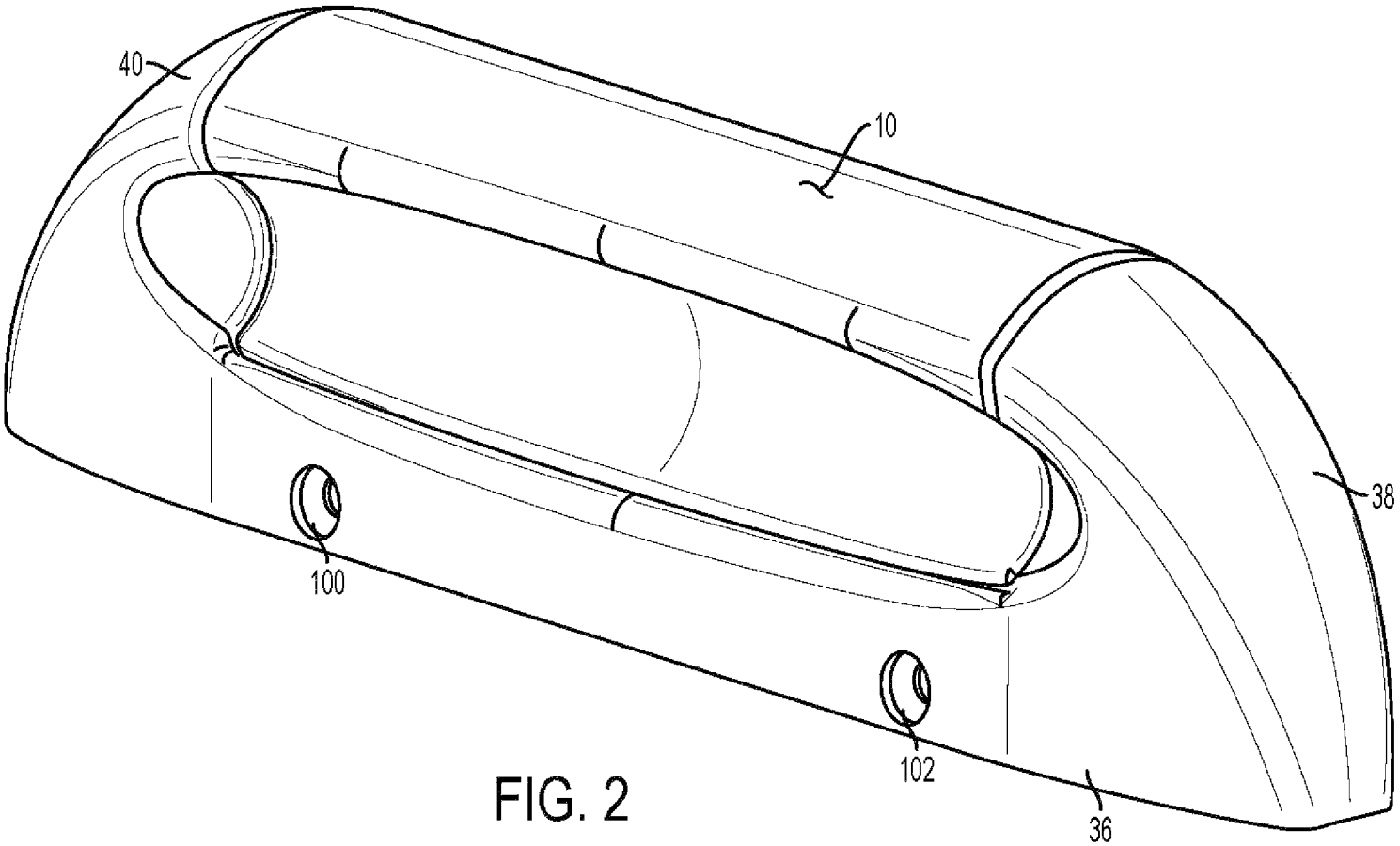
FIG. 2 is an assembled perspective view of the handle mechanism seen in FIG. 1.

Referring to FIGS. 1 and 2, the handle 10 includes a pair of opposed inserts 12, 14 that fit into opposed ends 16, 18 of the handle 10. Each handle insert has a corresponding planar surface (20 on insert 12, 22 on insert 14) with a corresponding pivot opening (24 on surface 20 of insert 12 and 26 on surface 22 of insert 14) that acts as a bearing for a respective pivot pin 28, 30.

The pivot pins 28, 30 are axially aligned and are held in respective clips 32, 34 installed in a handle base 36. The handle base has two arms 38, 40 that extend to opposite sides of the handle 10 to provide a smooth complete configuration as seen in FIG. 2 when the handle mechanism is fully assembled. Each of the arms 38, 40 includes a corresponding smooth planar surface (42 on arm 40 and 44 on arm 38) to the planar surfaces 20, 22 on the handle inserts.

The handle inserts are preferably made of a high density plastic and the planar surface contact between the opposed surfaces (planar insert surface 20 to planar arm surface 44 and planar insert surface 22 to arm surface 42) provides smooth and quiet operation as the handle pivots about pivot pins 28, 30.

The pivot pins 28, 30 are initially installed into their respective clips 32, 34 in respective bearing openings 46, 48. The pivot pins are axially slidable in the bearing openings 46, 48 between extended and retracted positions.

The clips 32, 34 fit into the handle base 36. More specifically, they snap into the corresponding arms 38, 40. Snap clips 50, 52 engage the handle base to hold the clips in place. With the pivot pins retracted into their respective bearing openings 46, 48, the handle 10, with the inserts 12, 14 installed fits between the handle base arms 38, 40 with the insert pivot openings 24, 26 aligned with the retracted pivot pins.

The pins can then be driven outwards from the clips and towards each other into the aligned insert pivot openings 24, 26, by sliding wedges 54, 56 into their respective clips 34, 32. As wedge 54 slides into clip 34, surface 58 contacts the left end of pin 30 (in FIG. 1) and drives the pin towards the right, extending it out of the clip opening 48 so that the right end of pin 30 engages pivot opening 26 in the insert 14.

Wedge 56 is installed in the same way so that surface 60 on the wedge drives pin 28 to the left into the pivot opening 24 of right insert 12. The wedges preferably snap into their respective clips to remain in position after installation. The handle is then free to pivot along an axis defined by the axis of the pivot pins over a small angular range of motion. The wedges, inserts, and clips are all preferably made of a high density plastic.

To remove the handle 10 from the base 36, the wedges are provided with corresponding openings 62, 64 that are accessible via notches 66, 68 in their respective clips. A screwdriver blade or other tool can be inserted into the notch 66 to engage the wedge 56 and snap it out of clip 32. The clip is designed so that the screwdriver can then be inserted up into the clip to engage a groove formed around each pivot pin (groove 70 on pin 28 and groove 72 on pin 30). This allows the blade of the screwdriver to slide the pivot pin axially away from the handle 10 and out of engagement, back to the retracted position. With each pivot pin retracted, the handle can then be removed for repair or replacement.

Figure 4:
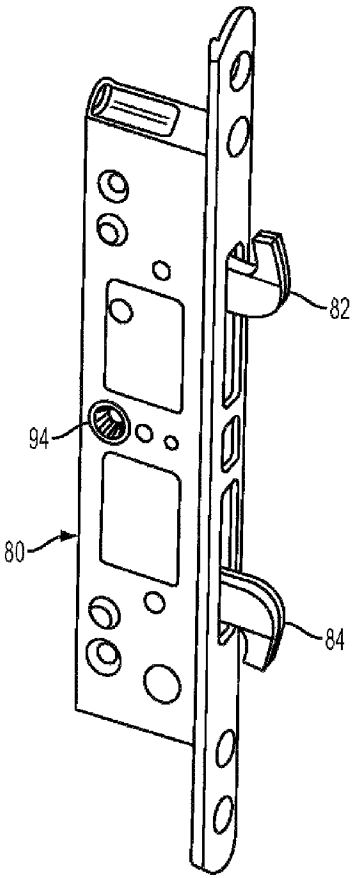
FIG. 4 shows a conventional mortise lock suited for use with the handle mechanism of FIG. 1.
Figure 3B:
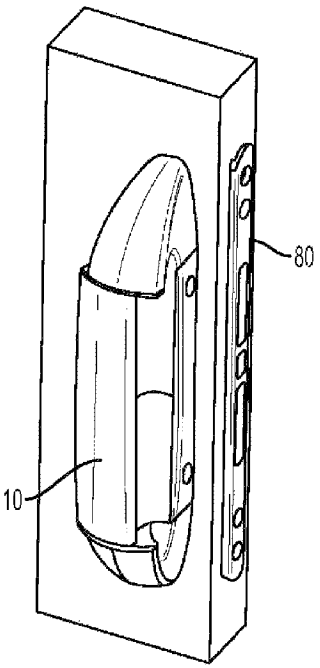
FIG. 3*b* corresponds to FIG. 3*a* except the handle mechanism is shown with the handle and hook latches of the mortise lock in the unlatched position (door open or ready to slide open).
Figure 3A:
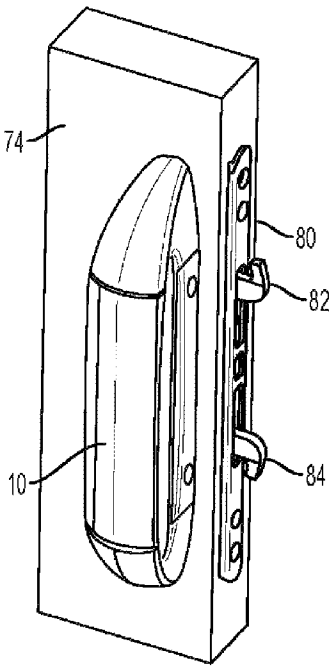
FIG. 3*a* shows the handle mechanism of FIG. 1 installed on a vertical door stile (only a portion of the stile is shown) with a mortise lock having a pair of extended hook latches. The handle and hook latches of the mortise lock are shown in the latched position (door closed).

FIG. 3*a* shows how the handle appears after it is finally mounted to a vertical stile 74 of a sliding door. The handle is shown with the mortise lock 80 (see FIG. 4) latched and hook latches 82, 84 extended. As can be seen in FIG. 3*a*, the mortise lock 80 is mortised into the vertical door stile 74 on the sliding door. The right edge of the door will typically abut a corresponding vertical door jamb having a pair of openings in a strike plate that the hook latches engage.

Figure 5:
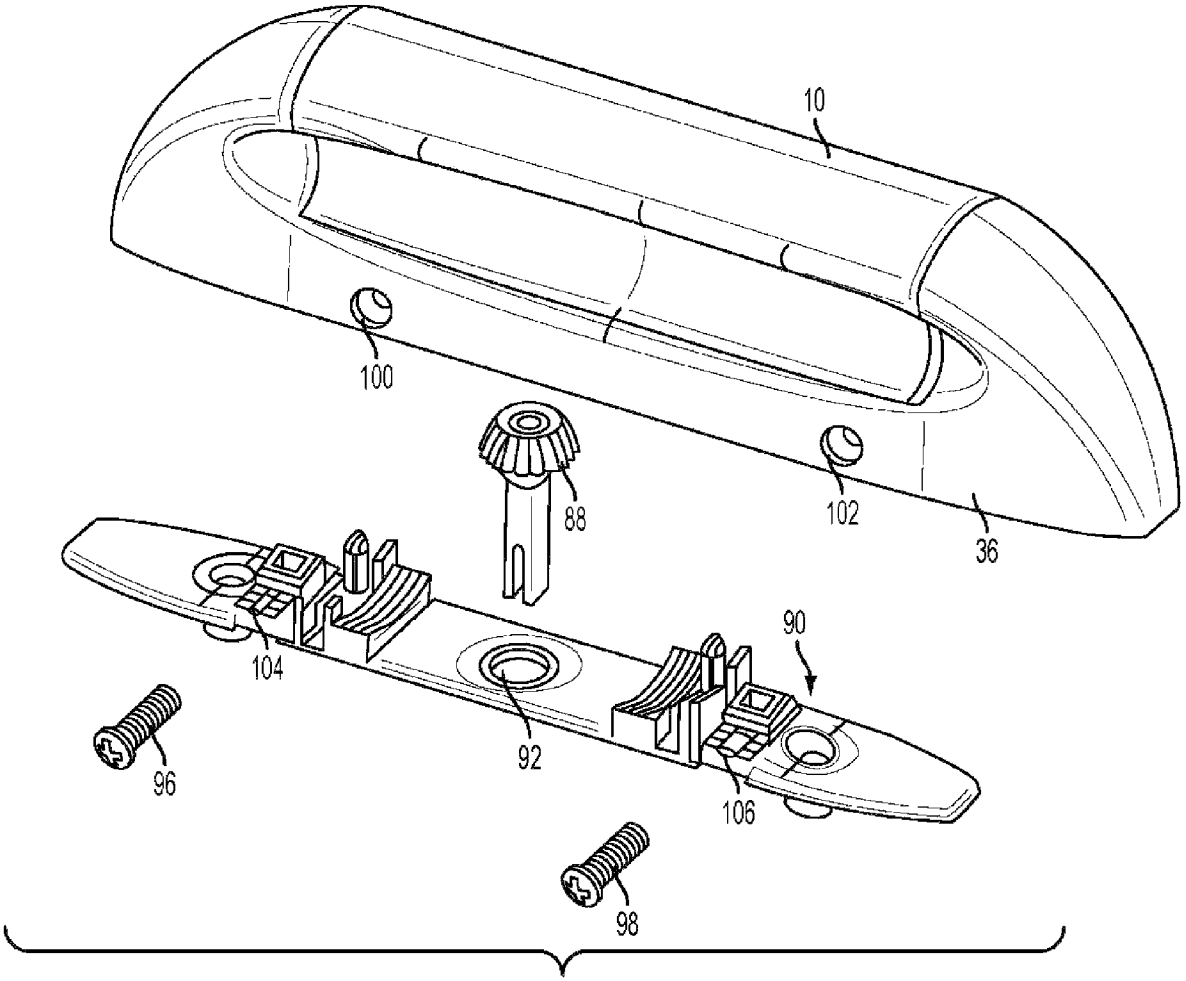
FIG. 5 shows the handle mechanism of FIG. 1 with a mounting plate and pinion gear for attaching the handle mechanism of FIG. 1 to a door and driving a mortise lock as seen in FIG. 4.

FIG. 3*b* shows the handle 10 pivoted to the open or unlatched position. Note in FIG. 3*a* that the hook latches 82, 84 are extended out to engage the strike plate in an adjacent door jamb (not shown). In FIG. 3*b*, the handle 10 has been pivoted away from the edge of the door. This pivoting motion rotates partial bevel gear 86 (see FIG. 1) which is attached to the underside of handle 10. The partial bevel gear rotates as the handle rotates about the pivot pins. The partial bevel gear is fixed to the handle and has a center of rotation on the axis of the pivot pins so that rotation of the handle directly drives the pinion bevel gear 88 (see FIG. 5) installed on mounting plate 90 (see FIG. 5).

Note that the perimeter of the mounting plate is just smaller than the internal perimeter of the handle base so that the handle base fits over the mounting plate and substantially completely hides it when the handle base is installed.

Mounting plate 90 is installed on the surface of door stile 74, and pinion gear 88 is inserted through opening 92 on the mounting plate, through a corresponding hole in the stile and into drive hub 94 (see FIG. 4) on the mortise lock 80. A square spindle shaft on the end of the pinion gear engages a corresponding conventional square drive opening on the mortise lock.

Mounting screws (not shown) are used to attach the mounting plate to the door stile and/or the mortise lock 80 to secure the mounting plate in the desired location. The handle base 36, with the handle 10 is installed onto the mounting plate with base mounting screws 96, 98 that extend through holes 100, 102 in the base 36 and into threaded openings 104, 106 in the mounting base.

With the handle 10 and handle base 36 installed, the partial bevel gear 86 engages the pinion bevel gear 88 so that rotation of the handle from the position in FIG. 3*a* to the position in FIG. 3*b* rotates the pinion gear and the drive hub 94 on the mortise lock to retract the hook latches 82, 84 as seen in FIG. 3*b*.

The handle 10 rotates when force is applied parallel to the surface of the door away from the adjacent door jamb on the door frame. Initially, this force causes rotation of the handle 10 without moving the door. The hook latches retract as described. The rotation angle of the handle 10 is limited, however, so that continued application of force parallel to the door causes the now unlatched sliding door to slide open. Thus, the handle operates with one continuous motion to first unlatch and then slide open the door. The initial part of the motion pivots the handle to unlatch the door and the rest of the motion slides the door open so that the entire process is completed in an unbroken continuous action.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door handle for a sliding door comprising:

a handle base adapted for mounting on the sliding door;

a handle pivotally mounted on the handle base for rotation about a pivot axis;

a pair of clips mounted to the handle base on opposite sides of the handle;

a pair of sliding wedges insertable into the corresponding clips;

a pair of opposed pivot pins corresponding to the pair of clips and mounted within respective clips, the pivot pins being axially slidable along the pivot axis towards and away from each other and into and out of engagement with the handle to hold the handle in pivoting relationship to the handle base when the pivot pins slide axially towards each other, the handle being removable from the handle base when the pivot pins axially slide away from each other;

wherein the pair of sliding wedges correspond to the pair of opposed pivot pins, each wedge being movable between a second position and a first position, each wedge preventing axially sliding motion of its corresponding pivot pin away from the opposed pivot pin when in the second position and allowing axially sliding motion of its corresponding pivot pin away from the opposed pivot pin when in the first position whereby the handle may be removed when the pair of sliding wedges are in the first position and the pivot pins have been moved axially away from each other.

2. The door handle for a sliding door according to claim 1 wherein the pins are metal and the clips are plastic.

3. The door handle for a sliding door according to claim 1 wherein the wedges are held in the second position when the handle base is mounted on the sliding door.

4. The door handle for a sliding door according to claim 1 wherein the wedges are made of plastic and snap into the clips when moved to the second position.

5. The door handle for a sliding door according to claim 4 wherein each clip includes a notch positioned to allow a tool to pry against the corresponding wedge and unsnap the wedge from its corresponding clip when the wedge is in the second position.

6. The door handle for a sliding door according to claim 1 wherein the handle base is provided with a pair of arms extending away from the sliding door when the handle base is mounted on the sliding door and wherein the clips and pivot pins are mounted inside the arms of the handle base.

7. The door handle for a sliding door according to claim 6 wherein the clips further include snap clips for engaging the handle base to hold the clips inside the arms of the handle base.

8. The door handle for a sliding door according to claim 7 wherein the clips and snap clips are made of plastic.

9. The door handle for a sliding door according to claim 6 wherein:

each arm includes a corresponding smooth planar surface extending substantially perpendicularly away from the sliding door when the handle base is mounted on the sliding door;

the smooth planar surfaces of the arms are opposed to each other to form a space therebetween; and the handle pivots between the opposed smooth planar surfaces of the arms in the space therebetween.

10. The door handle for a sliding door according to claim 6 wherein the handle pivots between the arms and has a cross sectional shape corresponding to the arms to provide a smooth transitional shape from the handle to the arms.

11. The door handle for a sliding door according to claim 1 wherein the handle further includes two handle inserts located at opposite ends of the handle, each handle insert including a pivot opening for receiving one of the pivots.

12. The door handle for a sliding door according to claim 11 wherein the handle inserts are plastic and the handle is metal.

13. The door handle for a sliding door according to claim 11 wherein the handle inserts extend into hollow ends of the handle.

14. The door handle for a sliding door according to claim 1 wherein each pivot pin includes a groove formed therein to allow a tool to slide the pivot pin axially into and out engagement with the handle.

15. The door handle for a sliding door according to claim 1 wherein the handle base includes a mounting plate, the handle includes a handle gear and the mounting plate includes a pinion gear driven by the handle gear as the handle pivots.

16. The door handle for a sliding door according to claim 15 wherein the handle gear is a partial bevel gear and the pinion gear is a bevel pinion gear.

17. The door handle for a sliding door according to claim 1 wherein the handle base includes a mounting plate and the handle base extends around the mounting plate, the mounting plate being separately mountable to the sliding door and the handle base being thereafter attached to the mounting plate.

18. The door handle for a sliding door according to claim 17 further including:

a pair of wedges corresponding to the pair of pivot pins and slidable into corresponding ones of the pair of clips, each wedge being movable between a second position and a first position, each wedge preventing axially sliding motion of its corresponding pivot pin away from the opposed pivot pin when in the second position and allowing axially sliding motion of its corresponding pivot pin away from the opposed pivot pin when in the first position whereby the handle may be removed when the pair of wedges are in the first position and the pivot pins have been moved axially away from each other; and wherein the mounting plate acts to hold each wedge in the second position in its corresponding clip when the handle base is attached to the mounting plate.

19. A door handle for a sliding door comprising:

a handle base adapted for mounting on the sliding door, the handle base including a removable mounting plate having a pinion gear adapted for connection to a latching mechanism to latch the sliding door to a door frame and a pair of arms extending away from the handle base;

a handle pivotally mounted between the arms of the handle base for rotation about a pivot axis, the handle including a handle gear for driving the pinion gear as the handle pivots and a pair of handle inserts located in opposite ends of the handle, each handle insert having a pivot opening;

a pair of clips mounted in the arms of the handle base on opposite sides of the handle;

a pair of opposed pivot pins corresponding to the pair of clips and mounted within respective ones of the clips, the pivot pins being axially slidable along the pivot axis towards and away from each other and into and out of engagement with the pivot openings of the handle inserts to hold the handle in pivoting relationship to the handle base when the pivot pins slide axially towards each other, the handle being removable from the handle base when the pivot pins axially slide away from each other; and a pair of sliding wedges insertable into the clips, the wedges correspond to the pair of pivot pins and each wedge being movable between the second wedge position preventing the pivot pins from axially sliding away from each other and the first wedge position for allowing the pivot pins to axially slide away from each other to allow disengagement with and removal of the handle inserts when the wedges are in the first position.

* * * * *